United States Patent [19]

Wittmann et al.

[11] Patent Number: 4,872,272

[45] Date of Patent: Oct. 10, 1989

[54] DETACHABLE BINDING DEVICE FOR A SKI BOOT

[75] Inventors: Heinz Wittmann, Vienna; Roland Erdei, Pottendorf; Tibor Szasz, Vienna, all of Austria

[73] Assignee: TMC Corporation, Switzerland

[21] Appl. No.: 174,993

[22] PCT Filed: Apr. 18, 1987

[86] PCT No.: PCT/EP87/00211

§ 371 Date: Jan. 5, 1988

§ 102(e) Date: Jan. 5, 1988

[87] PCT Pub. No.: WO87/06802

PCT Pub. Date: Nov. 19, 1987

[30] Foreign Application Priority Data

May 7, 1986 [AT] Austria ..... 1220/86

[51] Int. Cl.[4] ..... A43B 5/04; A63C 9/00

[52] U.S. Cl. ..... 36/117; 280/615

[58] Field of Search ..... 36/117–121; 280/615; 24/265 AL

[56] References Cited

U.S. PATENT DOCUMENTS

| | | | |
|---|---|---|---|
| 1,621,076 | 3/1927 | Lotz | 24/265 AL |
| 4,309,833 | 1/1982 | Salomon | 36/117 |
| 4,334,367 | 6/1982 | Salomon | 36/117 |
| 4,553,771 | 11/1985 | Bernard et al. | 280/615 |

FOREIGN PATENT DOCUMENTS

| | | | |
|---|---|---|---|
| 0095400 | 11/1983 | European Pat. Off. . | |
| 2622966 | 4/1977 | Fed. Rep. of Germany . | |
| 2948313 | 6/1980 | Fed. Rep. of Germany . | |
| 3002874 | 2/1984 | Fed. Rep. of Germany . | |
| 3334144 | 4/1984 | Fed. Rep. of Germany | 36/117 |
| 1088844 | 9/1954 | France | 280/615 |
| 2443814 | 7/1980 | France . | |
| 2457081 | 12/1980 | France . | |
| 2556569 | 6/1985 | France | 36/117 |
| 103316 | 12/1941 | Norway | 280/615 |
| 104468 | 5/1942 | Norway | 280/615 |
| 138832 | 8/1978 | Norway . | |

*Primary Examiner*—James K. Chi

*Attorney, Agent, or Firm*—Finnegan, Henderson, Farabow, Garrett & Dunner

[57] ABSTRACT

The invention concerns a device for detachably fastening a ski boot to a ski binding fixable on the ski, the ski boot comprising a hook element extending in its longitudinal direction. In manner known per se the hook element consists of a wire material which is bent several times and of which the cross rod is located at a distance from the front ski boot end, and where legs joining the cross rod are anchored by bent, free wire segments in the front end of the ski boot sole. In the invention, the free wire segments (6,7) of each leg (4,5) of the hook element (2) are additionally bent by an angle (alpha) toward the cross rod (3), whereby improved anchoring of the hook element (2) and improved force spreading between the hook element and the ski boot (1) is achieved. In further essence of the invention, the individual legs (4,5) are divided into at least three wire segments assuming directions deviating from the preceding and/or following wire segments.

8 Claims, 2 Drawing Sheets

DETACHABLE BINDING DEVICE FOR A SKI BOOT

BACKGROUND OF THE INVENTION

The invention concerns a device to detachably fasten a ski boot to a ski binding fixable to a ski.

It has long been known already from Norwegian Patent No. 138,832 to provide the front ski boot end with a hook element to achieve detachable fastening to a ski binding. Furthermore, a cast attachment of a hook element into a plastic sole is known from German Auslegeschrift No. 26 22 966.

A ski binding of the above cited type illustratively is disclosed in German Offenlegungsschrift No. 30 02 874. In this known device, the hook element, when seen in topview (FIG. 4 of this document), assumes the approximate shape of a square ring, the free wire segments of each leg being bent toward each other and made to align. Even though this known solution has been found useful in practice, there are signs nevertheless that the stated shape of the hook element is not the most appropriate for all conceivable link mechanisms. Also, the annular shape of the hook element precludes further developments even where called for on practical grounds.

SUMMARY OF THE INVENTION

Accordingly, it is an object of the present invention to so design and shape a device of the initially cited kind that shall allow further developments without thereby abandoning the concept of fastening the ski boot to the ski binding. Moreover, diverse sptial arrangements shall be made possible and there shall be adaptability to various material links.

Because the bent free wire segments of each leg are bent once more toward the cross rod, the hook element of the subject invention enjoys a hook-like support inside the front of the ski boot as seen in the direction of the load, whereby even adverse, unilateral stresses, which are known from experience to be commonplace when the ski boot is used in motion, can be better absorbed by the ski boot than in the solution of the state of the art.

Seen in the direction of the load, the change in direction of adjoining wire segments also provides a hook-like rest for the hook element at the fore of the ski boot. Furthermore, the hook element is made stiffer because its individual legs are braced.

The features of the subject invention achieve improved force spreading because the hook element is supported over the entire space of the front of the ski boot.

The features of the subject invention also achieve a hook element geometry matching the outer shape of the front of the ski boot. Thereby, the side surfaces of the ski boot are reinforced.

The features of the subject invention further allow intensive reaction to the load in that the wire segments in the longitudinal direction of the ski boot of the individual legs are divided into sub-segments pointing in different directions.

The features of the subject invention also relate to assuring natural rolling-off motion of the ski boot to correspond to the natural motion of the skier's foot. These features take into account the foot's roll-off motion taking place over the area of the big toes.

The features of the subject invention achieving reinforcement at the fore of the ski boot take this concept of the invention further.

Further features, advantages and details of the invention shall now be described more closely in relation to the drawings showing several embodiments of the subject invention.

BRIEF DESCRIPTION OF THE DRAWINGS

FIGS. 1 through 3 show a first embodiment with inwardly doubly bent free wire segments of the individual legs of the hook element, FIG. 1 showing the hook element in topview for the ON position in a ski boot, while FIGS. 2 and 3 are a topview and an elevation view of the hook element, respectively.

DETAILED DESCRIPTION OF THE PREFERRED EMBODIMENTS

Figure 1:
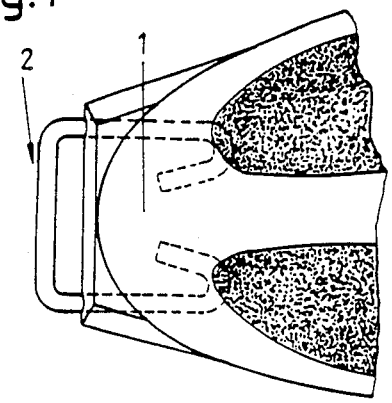
Figure 2:
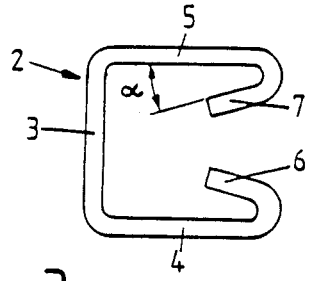
Figure 3:
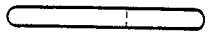

As can be seen from the first embodiment of FIGS. 1 through 3, a hook element denoted in its entirety by 2 is cast in known manner into the front 1 of a ski boot. This front 1 of the ski boot also consists in manner known per se of plastic. Again the manufacturing process is known per se and is not an object of the present invention.

The hook element 2 comprises a cross rod 3 and two legs 4,5 angled to it. The free wire segments 6,7 of the individual legs 4,5 are bent around toward each other and then additionally again at an acute angle alpha toward the cross rod 3. The magnitude of the angle alpha is up to 80°, preferably 60°–75°. For the sake of clarity, the embodiment shows an angle alpha about 20°.

Figure 4:
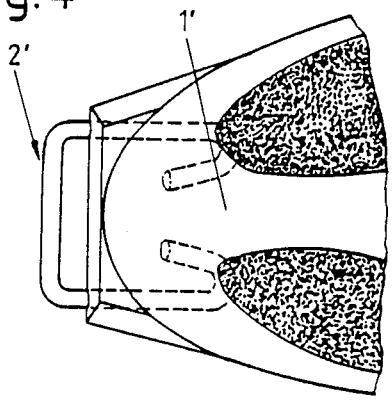
FIGS. 4 through 6 illustrate a further design mode of the first embodiment, having individual-leg wire segments additionally bent out of the plane of the hook element, similarly to FIGS. 1 through 3.
Figure 5:
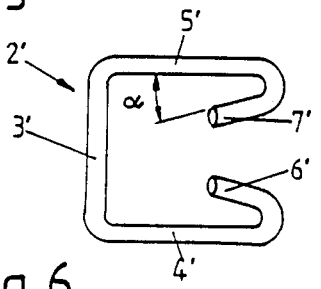
Figure 6:
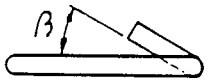

In the embodiment of FIGS. 4 through 6 the hook element 2' essentially corresponds to the first embodiment except that the free ends 6', 7' of the individual legs 4', 5' of the hook element 2' are bent out of its plane by an angle beta. The magnitude of the angle beta is up to 45°, preferably 15°–30°.

Figure 7:
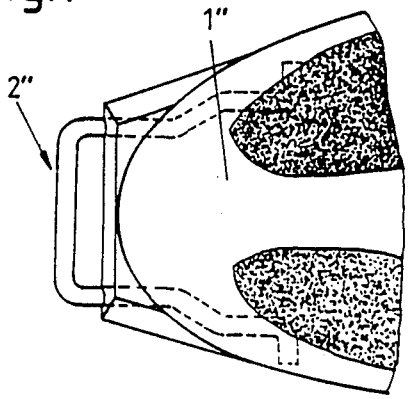
FIGS. 7 through 9 illustrate a third embodiment of the subject invention wherein the legs of the hook element are shown angled several times corresponding to the outer shape of the front of the ski boot and have outwardly bent free wire segments, similarly to FIGS. 1 through 3.
Figure 8:
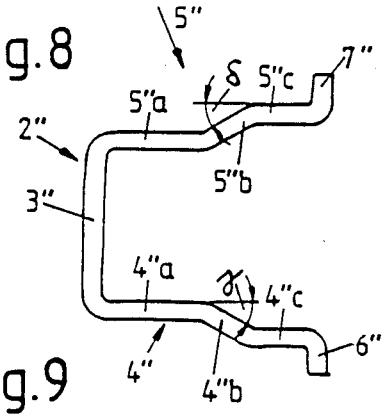
Figure 9:
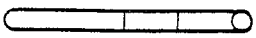

In the embodiment of FIGS. 7 through 9, the hook element 2'' is designed with the individual legs 4'', 5'' being divided into three wire segments. The first wire segments 4''*a*, 5''*a* orthogonally join the cross-rod 3'' and the second adjoining wire segments 4''*b*, 5''*b* subtend an outward angle gamma. Again straight wire segments 4″c, 5″c join those wire segments and form an angle delta with them. The free wire segments 6″, 7″ of each leg 4″, 5″ in this case form an outward right angle. The angles gamma and delta are about 45°.

Figure 10:
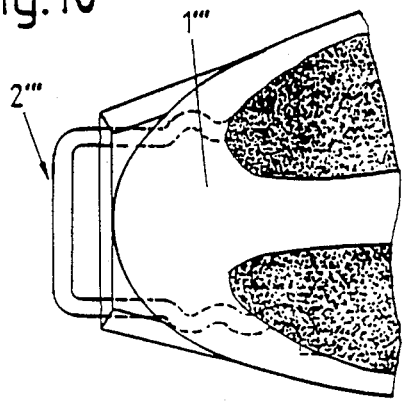
FIGS. 10 through 12 illustrate a fourth embodiment of the subject invention wherein the individual legs of the hook element per se comprise several bends but otherwise are similar by their outwardly free wire segments to the embodiment illustrated in FIGS. 7 through 9.
Figure 11:
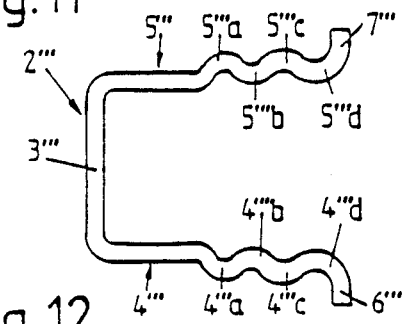
Figure 12:
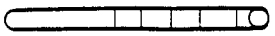

In the embodiment of FIGS. 10 through 12, the hook element 2‴ is provided with several bends at its legs 4‴, 5‴. These bends are in opposite directions; this embodiment shows the bent wire segments 4‴a, 4‴b, 4‴c, 4″d and 5‴a, 5‴b, 5‴c, 5‴d, the free ends 6‴ and 7‴ joining the last wire segments 4‴d and 5‴d respectively.

Figure 13:
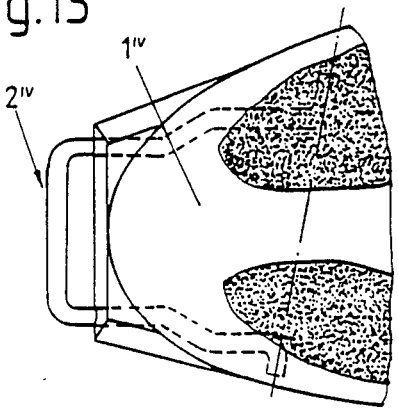
FIGS. 13 through 15 show an arrangement of the free wire segments forming a kind of pivot axis that, referred to the hook element longitudinal axis, forms an acute angle with it, but otherwise is similar to the embodiment illustrated in FIGS. 7 through 9.
Figure 14:
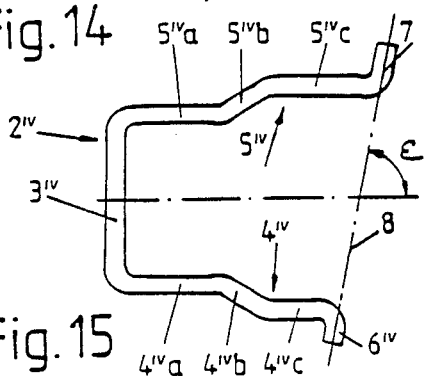
Figure 15:
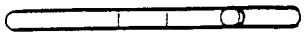

The embodiment of FIGS. 13 through 15 shows a hook element $2^{IV}$ which is similar to the design of FIGS. 7 through 9. The corresponding wire segments are denoted by $4^{IV}a$, $4^{IV}b$, $4^{IV}c$ and $5^{IV}a$, $5^{IV}b$, $5^{IV}c$ and again the free wire segments $6^{IV}$ and $7^{IV}$ join the wire segments $4^{IV}c$ and $5^{IV}c$ are resp. The difference relative to the embodiment of FIGS. 7 through 9 is that the leg $5^{IV}$ is extended compared to the leg $4^{IV}$ and in the concrete embodiment in that the wire segment $5^{IV}c$ is longer than the wire segment $4^{IV}c$. As a result the free wire segments $6^{IV}$ and $7^{IV}$ are aligned and determine an ideal pivot axis 8 of which the direction deviates from the normal to the longitudinal axis of the hook element $2^{IV}$ and subtends an acute angle with same. As a result, the roll-off motion is advantageous because by experience the skier moves more about his big toes in the area of the ball of the foot than in that in the direction of his small toes.

Figure 16:
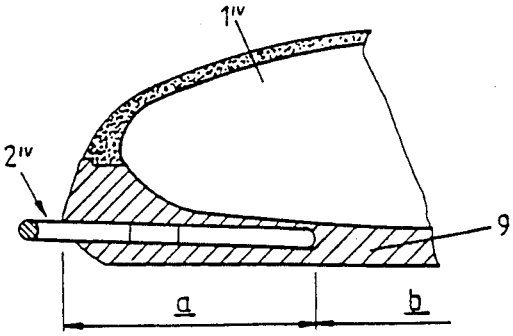
FIG. 16 is a partial section relating to the design of FIG. 13, wherein the walking sole is reinforced up to that area receiving the hook element relative to the wider area of the walking sole.

This sequence of motion is further favored as shown by FIG. 16 in that the area of the walking sole 9 around the hook element $2^{IV}$ is made of a stiffer material. This is taken into account as shown in FIG. 16 by the stiffer area being denoted by *a* and the further area of the travel sole 9 being denoted by *b*.

The invention is not restricted to the embodiments shown. Further variations are conceivable that would not transcend the scope of protection. Illustratively the free ends of FIGS. 7 through 9 or 10 through 12 or 13 through 15 might be bent, not outward, but inward. Again it is conceivable, both as regards the embodiment modes already shown and the presently cited design, to additionally bend the free ends of the individual legs similarly to the embodiment of FIGS. 4 through 6 out of the plane of the hook element. Again it is conceivable to carry out this bending not upwards but downwards, assuming of course there be enough space for that purpose and that it appear appropriate whatever the reason. Lastly it is conceivable also for the embodiment of FIGS. 1 through 3 and 4 through 6 the make the legs of different sized, similarly to the case for the embodiment of FIGS. 13 through 15.

There is no need to represent ski bindings suitable in the use of a ski boot with a hook element as shown above in the light of the most diverse ski bindings that are applicable with similar ski boots. Again there is no need to show in closer detail the anchoring of the hook element into a reinforcement part in the boot sole as illustratively described in the German Offenlegungsschrift No. 33 34 144. This document shows that the hook element of the invention also can be used with such a seating part and shall also be protected when used in that form.

We claim:

1. A device for detachably fastening a ski boot to a ski binding, comprising:

a hook element (2) extending in a longitudinal direction of said ski boot and being rigidly connected to a travel sole (9) of said ski boot, said hook element including a plurality of bent portions, a cross rod fixed into a predetermined distance away from the front end of said ski boot and extending transverse to said longitudinal direction, and first and second legs (4, 5) extending in said longitudinal direction, each of said legs including at least one segment (6, 7) bent in the plane of said hook element by a first predetermined angle (alpha) toward said cross rod.

2. A device according to claim 1, wherein each of said first and second legs comprises at least two segments extending in different directions.

3. A device according to claim 1, wherein each of said segments (6, 7) extend from said hook element at a second predetermined angle (beta).

4. A device according to claim 1, wherein each of said first and second legs comprise first, second, and third segments, said first segments being orthogonal to said cross rod, said second segments extending outward at a third predetermined acute angle (gamma) and said third segments adjoining said second segments at a fourth predetermined acute angle (delta) and extending parallel to said first segments.

5. A device according to claim 2, wherein each of said first and second legs comprises first, second, third and fourth adjoining angled segments each forming an acute angle with each adjoining segment.

6. A device according to claim 2, wherein one of said first and second legs is longer than the other of said first and second legs, the ends of said first and second legs creating a pivot axis (8) subtending a fifth predetermined acute angle (epsilon) with respect to said longitudinal direction.

7. A device according to claim 1, wherein said portion of said travel sole connected to said hook element is reinforced relative to other portions of said travel sole.

8. A device according to claim 4, wherein the each of said third predetermined acute angle (gamma) and said fourth predetermined acute angle (delta) are substantially 45°.

* * * * *